US010793391B2

(12) United States Patent
Grillet

(10) Patent No.: US 10,793,391 B2
(45) Date of Patent: Oct. 6, 2020

(54) OPTICAL FIBER MANUFACTURING MACHINE AND METHOD FOR POSITIONING THE OPTICAL FIBER IN A MACHINE OF SAID TYPE

(71) Applicant: Conductix Wampfler France, Colombes (FR)

(72) Inventor: Michel Grillet, La Motte Servolex (FR)

(73) Assignee: Conductix Wampfler France, Colombes (FR)

( * ) Notice: Subject to any disclaimer, the term of this patent is extended or adjusted under 35 U.S.C. 154(b) by 528 days.

(21) Appl. No.: 15/569,281

(22) PCT Filed: Apr. 29, 2016

(86) PCT No.: PCT/FR2016/051007
§ 371 (c)(1),
(2) Date: Oct. 25, 2017

(87) PCT Pub. No.: WO2016/174364
PCT Pub. Date: Nov. 3, 2016

(65) Prior Publication Data

US 2018/0127231 A1 May 10, 2018

(30) Foreign Application Priority Data

Apr. 29, 2015 (FR) ..... 15 53839

(51) Int. Cl.
*B65H 57/00* (2006.01)
*B65H 51/12* (2006.01)
*B65H 51/18* (2006.01)

(52) U.S. Cl.
CPC ..... *B65H 57/003* (2013.01); *B65H 51/12* (2013.01); *B65H 51/18* (2013.01); *B65H 2701/32* (2013.01)

(58) Field of Classification Search
CPC ..... B65H 57/003; B65H 51/12; B65H 51/18; B65H 2701/32
(Continued)

(56) References Cited

FOREIGN PATENT DOCUMENTS

EP 0514858 A2 11/1992
EP 0514858 A3 11/1992
(Continued)

OTHER PUBLICATIONS

International Search Report dated Jul. 29, 2016.
Preliminary Search Report dated Feb. 24, 2016.

*Primary Examiner* — William E Dondero
(74) *Attorney, Agent, or Firm* — Ryan T. Grace; Advent, LLP

(57) ABSTRACT

The invention relates to a machine (100) for manufacturing an optical fibre (200), characterised in that the machine comprises:

at least one capstan (20, 21) and at least one pulley (22), which define a run of the optical fibre in a main area (2) of the machine, an optical fibre guiding system comprising a transmission member (25) and a clamping element (26) that is rigidly connected to the transmission member (25) and is able to retain an end of the optical fibre (200), the transmission member (25) being arranged parallel to the run of the optical fibre, a device (5) for having the clamping element (26) automatically grip the optical fibre (200), said device comprising:

means (53) for placing the optical fibre in a starting position in which the optical fibre runs at a distance from the clamping element in a direction extending substantially perpendicularly to the clamping element (26), (Continued)

a fibre-spacing finger (51), that can move between a neutral position at a distance from the optical fibre located in the starting position and a position in which the finger (51) keeps the optical fibre at a distance from the starting position in such a way as to bring the optical fibre into an intermediate position opposite the clamping element (26), said means being designed to open the clamping element (26) when the finger (51) has brought the optical fibre (200) into the intermediate position and close the clamping element again when the finger (51) has returned to the neutral position thereof.

10 Claims, 6 Drawing Sheets

(58) Field of Classification Search
USPC ..... 226/92
See application file for complete search history.

(56) References Cited

FOREIGN PATENT DOCUMENTS

| | | | |
|---|---|---|---|
| EP | 0873962 | A1 | 10/1998 |
| EP | 2837591 | A1 | 2/2015 |
| JP | H09142870 | A | 3/1997 |
| JP | H09142870 | A | 6/1997 |
| WO | 0151911 | A1 | 7/2001 |

OPTICAL FIBER MANUFACTURING MACHINE AND METHOD FOR POSITIONING THE OPTICAL FIBER IN A MACHINE OF SAID TYPE

SCOPE OF THE INVENTION

This invention relates to an optical fibre manufacturing machine as well as a method for positioning the optical fibre in such a machine.

BACKGROUND OF THE INVENTION

During the manufacture of an optical fibre, it is known to scroll the optical fibre in a machine wherein the optical fibre is guided over its run. The manufacture can in particular comprise a mechanical test of the optical fibre, and/or a winding of the optical fibre (in other words, the reconditioning of a coil of long optical fibre into a plurality of coils that have a smaller length of optical fibre).

In such manufacturing operations, a machine is used comprising a plurality of pulleys along which the optical fibre scrolls.

Upstream of the machine, the optical fibre is supplied in the form of a coil, typically comprising several kilometres of optical fibre.

Coming out of the machine, the optical fibre is wound in the form of coils, which are generally of a more reduced size.

FIG. 1 schematically illustrates such a machine.

At present, the positioning of the optical fibre over all the pulleys is manually done by an operator.

With the optical fibre having a small diameter, it is fragile and handling it is therefore difficult.

Consequently, the time dedicated by the operator to positioning the optical fibre, either at the start of the manufacturing campaign, or after the optical fibre breaks during its scrolling in the machine, is relatively long, which encumbers the manufacturing cost of the optical fibre.

The document EP 0 514 858 describes an optical fibre manufacturing machine comprising a clamping element mounted on a rail extending along the machine to install the optical fibre on all the pulleys, while said pulleys are arranged alternatively on both sides of the run of the optical fibre transported in the clamping element. The pulleys are then moved towards a position wherein they define the run of the optical fibre during the normal functioning of the machine. However, no means enabling gripping the optical fibre by the clamping element to be facilitated is disclosed.

BRIEF DESCRIPTION OF THE INVENTION

An aim of the invention is to design a manufacturing machine whereon the positioning of the optical fibre is automated.

In accordance with the invention, an optical fibre manufacturing machine is proposed, comprising:

- at least one capstan and at least one pulley, said capstan(s) and pulley(s) defining a run of the optical fibre in a main area of said machine,
- an optical fibre guiding system, comprising a transmission member and a clamping element rigidly connected to said member, able to retain an end of the optical fibre, said transmission member being arranged parallel to the run of the optical fibre,
- a device for having the clamping element automatically grip the optical fibre, comprising:

- means for positioning the optical fibre in a starting position where the optical fibre runs at a distance from the clamping element in a substantially perpendicular direction to said clamping element,
  - a fibre-spacing finger, that can move between a neutral position, at a distance from the optical fibre in its starting position, and a position where said spacing finger keeps the optical fibre at a distance from said starting position in such a way as to bring it into an intermediate position facing the clamping element,
  - means for opening and closing the clamping element, configured to open the clamping element when the optical fibre has been brought by the spacing finger into said intermediate position, and to close said clamping element when the spacing finger comes back to its neutral position.

By "manufacture", in this text, this means any step implemented between the manufacture of an optical fibre and its use. This term, in particular, covers the mechanical test of the optical fibre, as well as its possible winding.

According to an embodiment, the device for having the clamping element automatically grip the optical fibre, further comprises an optical fibre cutting tool.

According to an embodiment, the spacing finger is connected to a pivoting support.

Advantageously, the spacing finger has a curved shape, with its concavity oriented towards the optical fibre.

According to an embodiment, the device for having the clamping element automatically grip the optical fibre comprises means for retaining an end of the optical fibre.

Advantageously, said retaining means comprises a slit configured to wedge the optical fibre.

According to an embodiment of the invention intended for the mechanical test of the optical fibre, the main area of the machine comprises an input capstan arranged in an upstream section of the main area on the run of the optical fibre and an output capstan arranged in a downstream section of the main area on the run of the optical fibre, the rotation speed of said capstans being adjustable in such a way as to generate a mechanical tension of the optical fibre between said capstans.

Another aim of the invention relates to a method of positioning the optical fibre in a machine such as described above.

Said method comprises:

- the insertion of the optical fibre on the positioning means, the spacing finger being in its neutral position,
- the actuation of the spacing finger towards its spacing position, in such a way as to space the optical fibre towards its intermediate position,
- the actuation of the opening and closing means of the clamping element to open the clamping element,
- the loosening of the spacing finger towards its neutral position in such a way as to release the optical fibre into the opening of the clamping element,
- the actuation of the opening and closing means of the clamping element to close the clamping element in such a way as to exert a tightening force on the optical fibre.

Advantageously, said method comprises, after the closing of the clamping element, the cutting of the optical fibre between the clamping element and the positioning means whereon the fibre is inserted.

After the cutting of the optical fibre, the method advantageously comprises the scrolling of the transmission member to position the optical fibre retained by the clamping element on said at least one capstan and said at least one pulley on the run of the optical fibre in the machine.

BRIEF DESCRIPTION OF THE DRAWINGS

Other characteristics and advantages of the invention will emerge from the detailed description which will follow, in reference to the appended drawings whereon.

DETAILED DESCRIPTION OF EMBODIMENTS OF THE INVENTION

Figure 1:
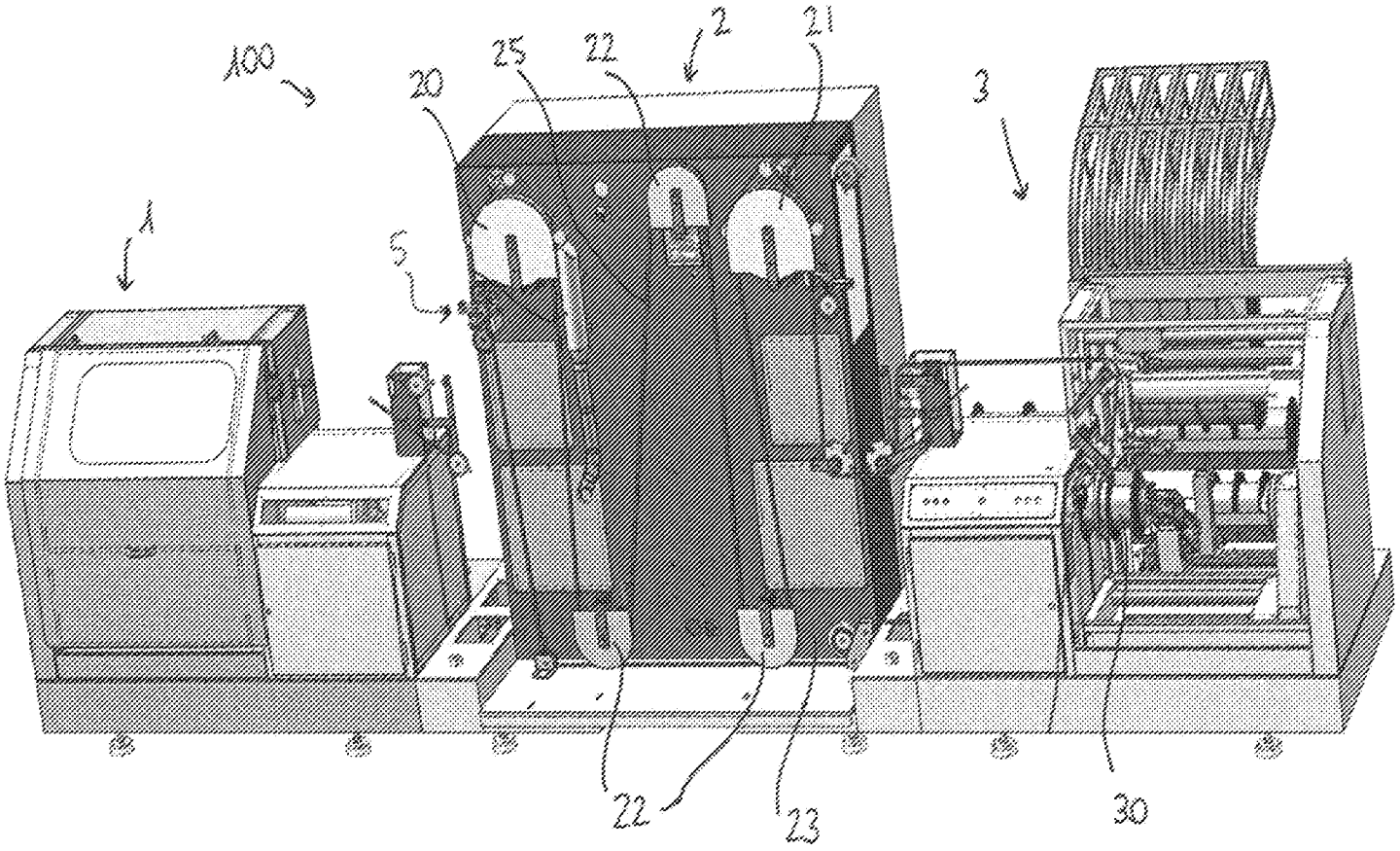
FIG. 1 is a schematic view of the whole of an optical fibre manufacturing machine according to an embodiment of the invention.

FIG. 1 is a view of the whole of the manufacturing machine according to an embodiment of the invention.

The machine 100 comprises, from the top to the bottom on the run of the optical fibre, an unwinder 1, a main area 2 and a winder 3.

The unwinder 1 is designed to retain a coil (not represented) of optical fibre intended to scroll in the main area of the machine.

The winder 3 is designed to retain an empty coil 30 whereon the optical fibre is wound coming out of the main area 2.

In the case illustrated in FIG. 1 where the machine is intended for the mechanical test of the optical fibre, the main area 2 comprises a frame 23 whereon, are arranged, an input capstan 20, an output capstan 21 and a plurality of pulleys 22 arranged between the capstans, capstan drums 20, 21 and pulley drums 22 being in one same vertical plane. The respective rotation speed of the capstans 20, 21 is chosen to apply a determined mechanical tension to the optical fibre. In other applications, in particular the winding, one single capstan (generally corresponding to the input capstan 20 in FIG. 1) can be sufficient, said capstan having the function of triggering the optical fibre. Likewise, the number of pulleys illustrated in FIG. 1 is only indicative, the machine being able to comprise one or several pulleys.

In view of transferring the optical fibre from the unwinder to the winder, the end of the optical fibre unwound from the coil 10 is inserted in the main area upstream of the input capstan 20, then it is guided between the different pulleys 22 up to the output capstan 21. Downstream of the output capstan 21, the optical fibre is guided up to the coil 30, in view of its winding on said coil.

To automatically insert the optical fibre in the main area then in the coil 30, said machine 100 comprises an optical fibre guiding system, comprising a transmission member 25 (for example, a chain or a strap) and a clamping element 26 (visible in FIGS. 2 to 6) connected to said transmission member 25 and comprising two jaws adapted to clamp the optical fibre when they are tightened. As will be seen below, the optical fibre guiding system comprises a device 5 enabling the automatic gripping of the optical fibre by the clamping element.

The transmission member 25 is arranged in the form of a continuous loop on the same face of the frame 23 as the capstans 20, 21 and the pulleys 22, travelling a run parallel to that of the optical fibre between said capstans and pulleys.

When a new optical fibre length must be transferred from the unwinder to the winder, an operator positions the optical fibre at the entrance of the main area 2 then the optical fibre gripping device 5 is actuated so that the clamping element comes to clamp a portion of the optical fibre in the vicinity of its end (for example, just upstream of the input capstan 20). Then, the transmission member 25 triggers the optical fibre retained by the clamping element at the level of the input capstan 20, all the pulleys 22 and the output capstan 21, up to the coil 30. To this end, the clamping element holds the optical fibre at a determined distance from the transmission member, chosen to enable the insertion of the optical fibre on each one of the pulleys.

Once the optical fibre has been guided up to the coil, the clamping element is brought back to the entrance of the main area then the transmission member is stopped.

FIGS. 2 to 6 illustrate an embodiment of the device 5 enabling the automatic clamping of the optical fibre by the clamping element.

Said device 5 is advantageously located at the entrance of the main area 2, in front of the input capstan 20.

The device 5 comprises a pulley 53 around which an operator passes the optical fibre 200 coming from the unwinder 1. This is substantially the only manual operation carried out to position the optical fibre in the machine.

According to an advantageous embodiment, the device 5 further comprises means for retaining the end 201 of the optical fibre. For example, as illustrated in FIGS. 2 to 6, said retaining means comprising a platform 54 fitted with a slit 54*a* at the bottom of which the optical fibre is likely to be wedged during its positioning by an operator. Preferably, the slit 54*a* runs at a tangent to the drum of the pulley 53.

However, the device 5 could comprise any other mechanical means for retaining the end of the optical fibre, for example, by clamping, without coming away from the framework of this invention.

The device 5 further comprises a cutting tool 55 in the form of scissors, intended to cut the optical fibre after it is gripped by the clamping element. The tool 55 is advantageously arranged between the pulley 53 and the clamping element 26 during the implementation of the method of gripping the optical fibre.

Figure 2:
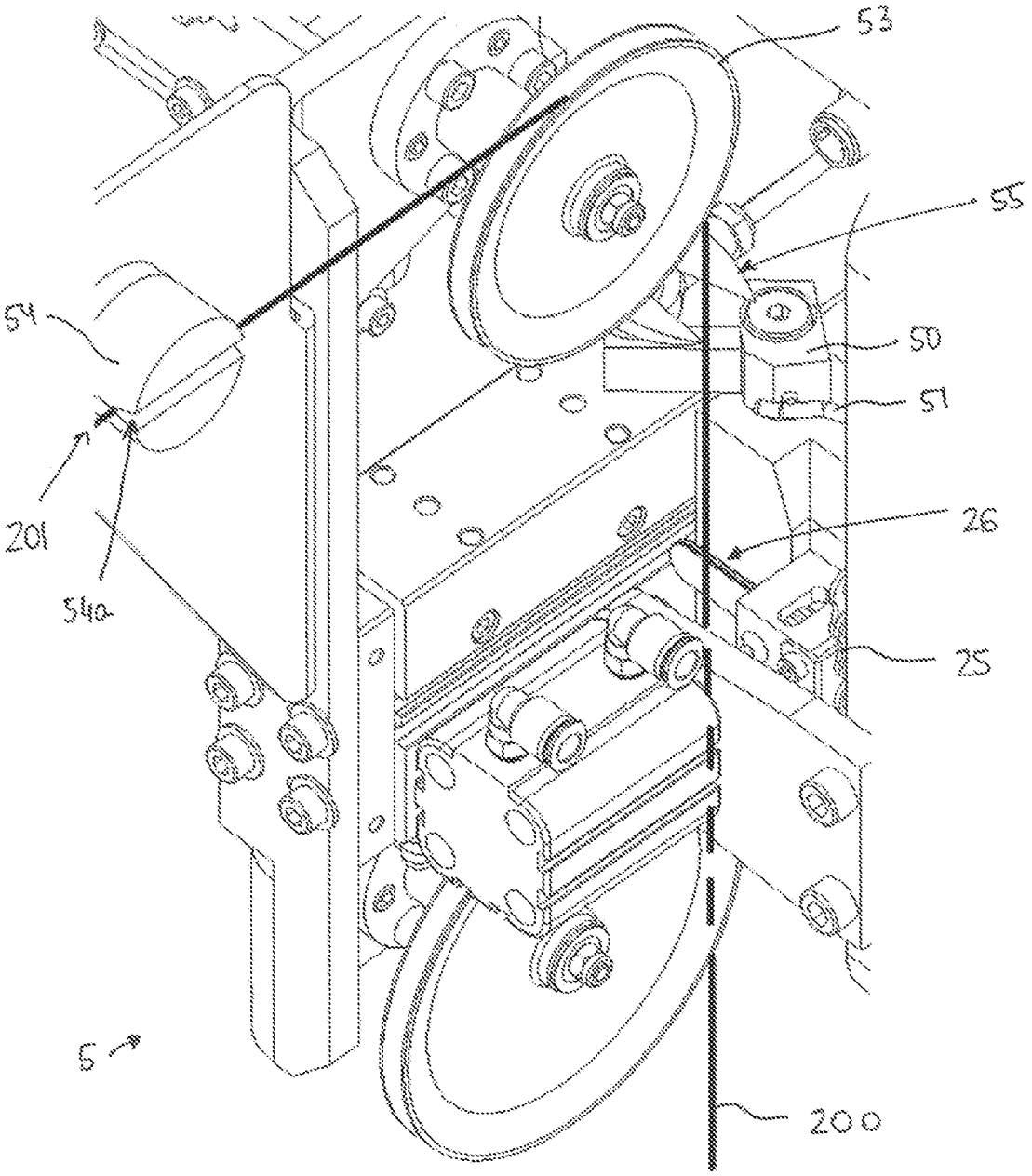
FIGS. 2 to 6 are perspective views of an optical fibre gripping device in the different steps of its use.

FIG. 2 illustrates the configuration of the device 5 after the operator has wedged the end of the optical fibre in the slit 54*a*.

In this configuration, the clamping element 26 is in a closed position and the optical fibre extend in a substantially vertical direction, at a distance from said clamping element. This configuration is known as the starting position of the optical fibre. The cutting tool 55 is in an open position, the optical fibre passing into the opening between the blades of said tool 55.

To enable the optical fibre to be inserted between the jaws of the clamping element 26, the device 5 comprises a spacing finger 51 adapted to space to provisionally space the optical fibre in view of bringing it in between the jaws of the clamping element in an open position.

Figure 3:
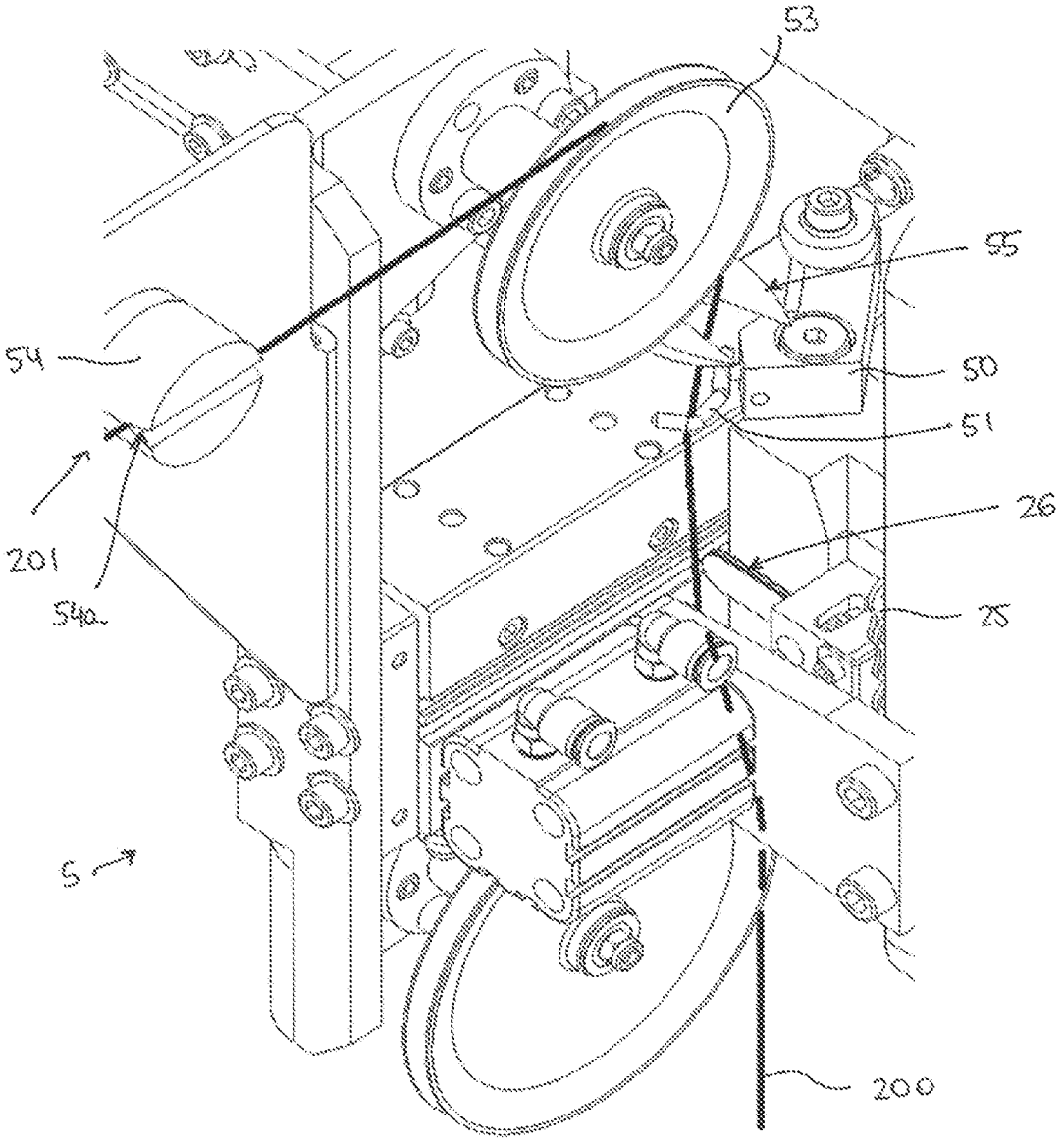

As can be seen better in FIG. 3, the spacing finger 51 has a curved shape.

The spacing finger 51 is connected to a support 50, able to pivot according to a substantially vertical axis, between a neutral position (see, in particular, FIG. 2) where the spacing finger 51 is retained at a distance from the optical fibre and from a spacing position of the optical fibre (see, in particular, FIG. 3). The support 50 is triggered by pivoting by an actuator, of which an end is connected to the frame and the opposite end is connected to a section of the support, at a distance from its pivoting axis. During this pivoting run, the spacing finger 51 comes into contact with the optical fibre and moves the optical fibre locally. The fact that the shape of the spacing finger 51 is curved, with its concavity oriented towards the optical fibre, prevents the optical fibre from escaping during the movement of the spacing finger.

The shape and size of the spacing finger and its pivoting amplitude are chosen, so that, in the spacing position, the optical fibre is located facing the end of the clamping element 26, which at this stage, is still in a closed position. This position is known as the intermediate position of the optical fibre.

Figure 4:
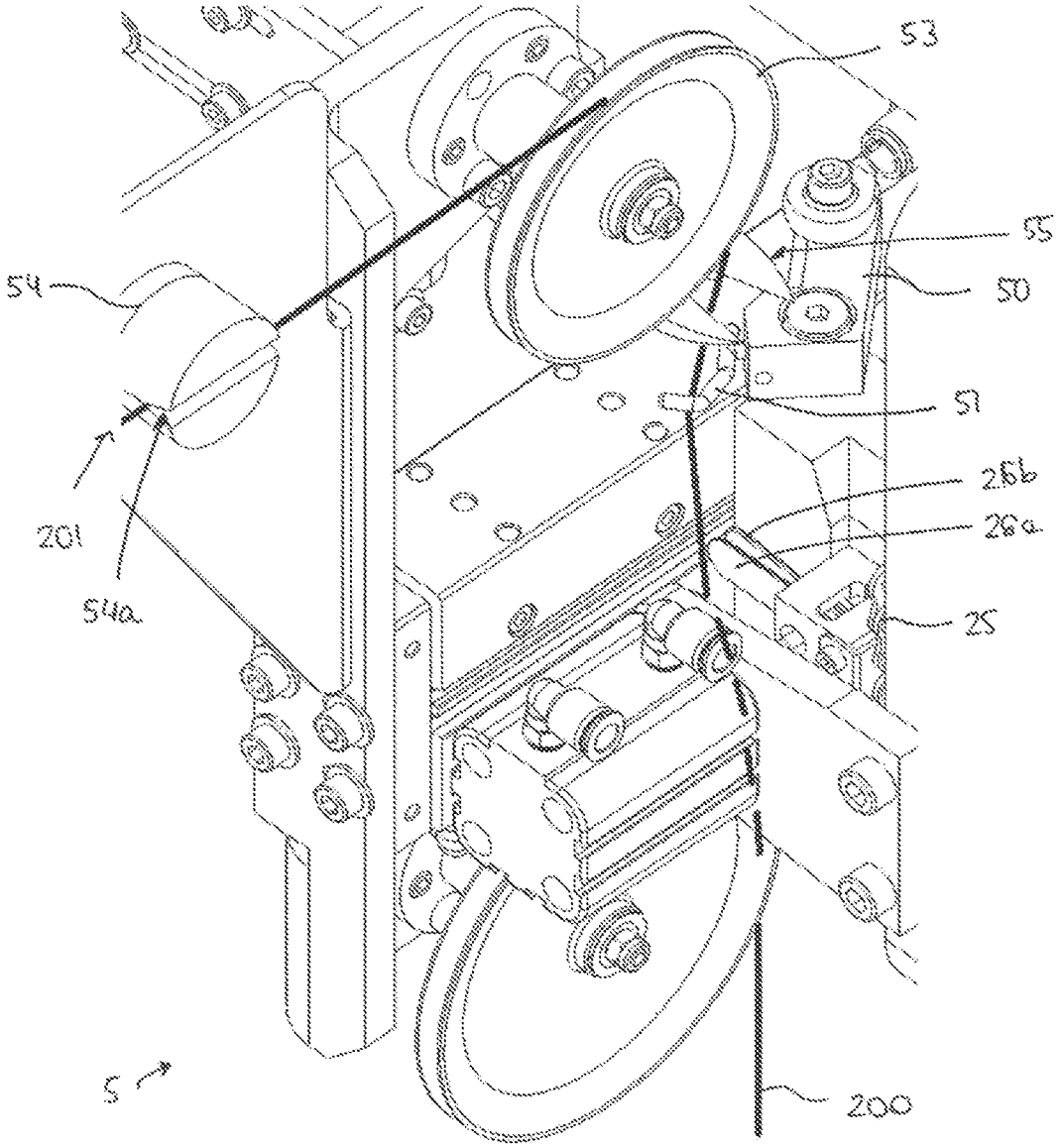

In a later step, illustrated in FIG. 4, the opening of the clamping element 26 is controlled: the jaws 26*a*, 26*b* are spaced apart and form an opening for the optical fibre 200 located opposite this opening.

Figure 5:
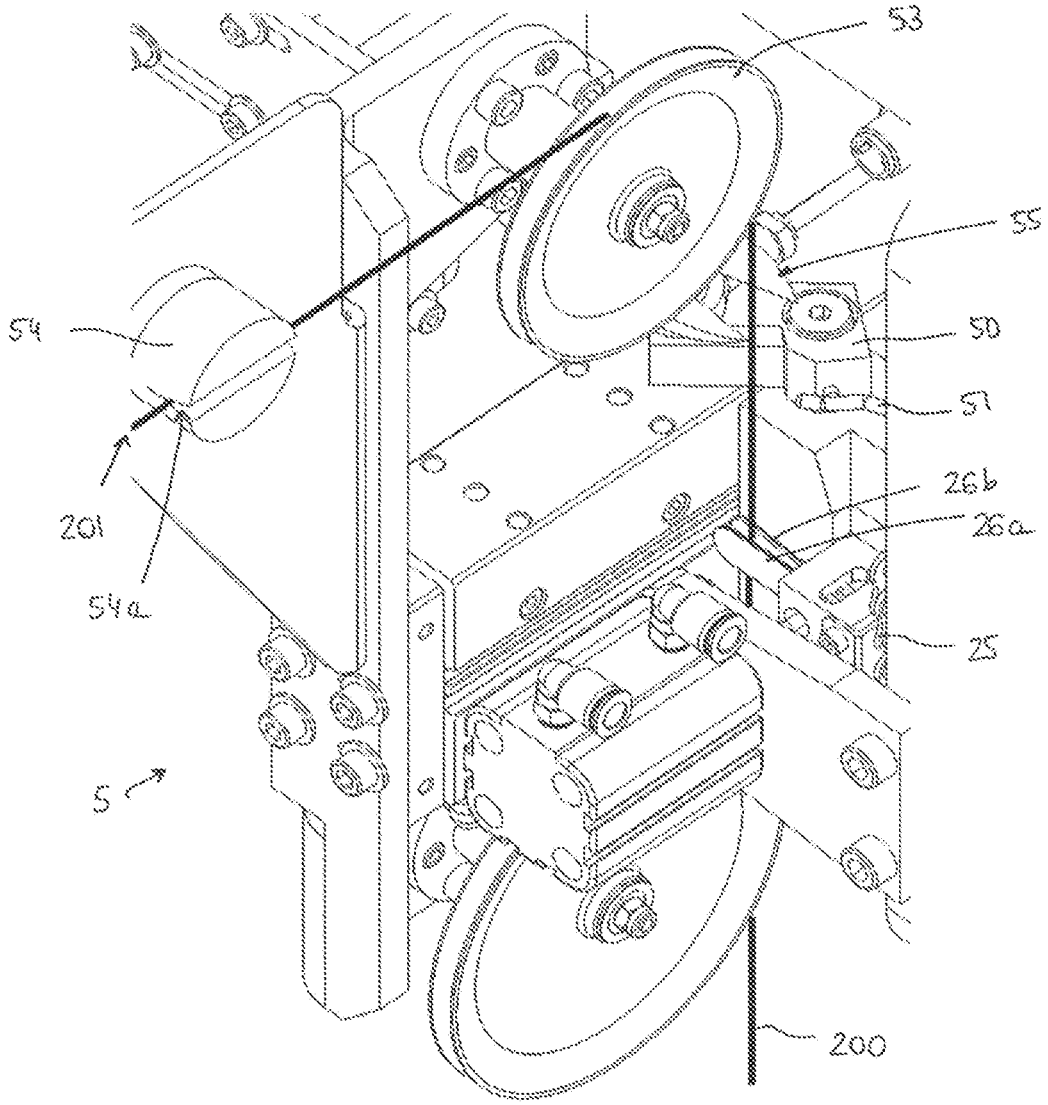

In reference to FIG. 5, the support 50 is brought back into its neutral position.

The spacing finger 51 then releases the optical fibre that it had spaced apart, but, in its return run to its starting position, the optical fibre is retained by a jaw 26*a* of the clamping element. The optical fibre 200 is then inserted between the jaws 26*a*, 26*b* of the clamping element.

Figure 6:
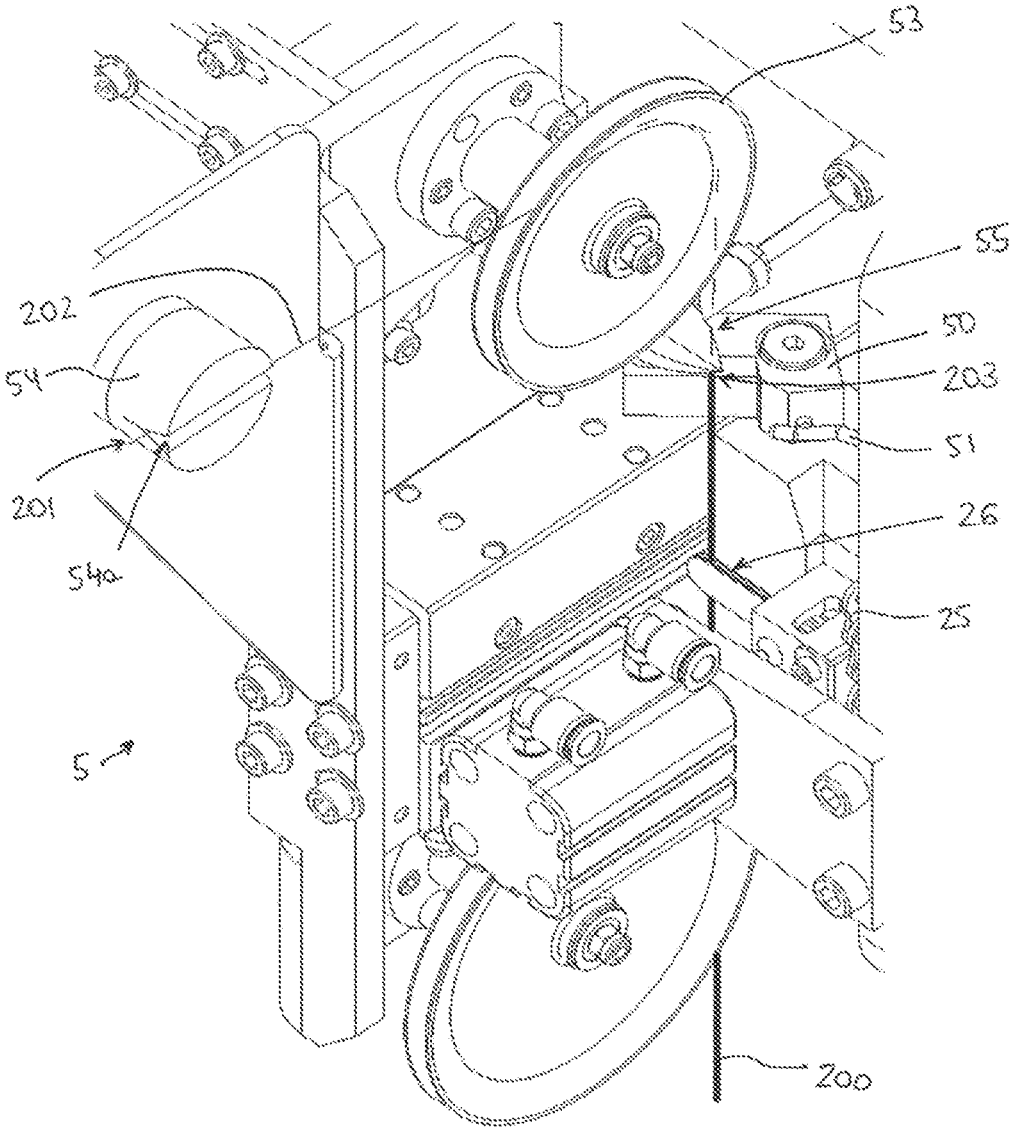

In reference to FIG. 6, the clamping element 26 is then closed, ensuring the optical fibre is retained by clamping.

Then the cutting tool 55 is actuated, in such a way as to cut the optical fibre in an area located between the end 201 and the clamping element 26. The portion 202 of optical fibre which has been cut is intended to be discarded. The end 203 resulting from the cutting is the end which will be brought up to the coil 30 by the transmission member 25.

The device 5 comprises a control system for the spacing finger 51, the clamping element 26 and the cutting tool 55, configured to synchronise the actuation of these elements in view of implementing the sequence described in reference to FIGS. 2 to 6.

Such a machine can find application in different optical fibre manufacturing steps. The run of the optical fibre, and the arrangement of the input and output capstans and the pulleys which result from this, are defined according to the limitations specific to each respective step.

For example, when the machine is intended for the mechanical test of the optical fibre, the main area is designed so that the optical fibre to be tested scrolls, undergoing a determined traction force between the input and output capstans.

Another application relates to a winding machine, enabling the optical fibre to be reeled off from a coil situated in the unwinder in a plurality of optical fibres that are shorter on the coils placed successively in the winder.

The invention claimed is:

1. A machine for manufacturing an optical fiber, comprising:

at least one capstan and at least one pulley, said capstan(s) and pulley(s) defining a run of the optical fiber in a main area of said machine;

an optical fiber guiding system comprising a transmission member and a clamping element rigidly connected to said member, able to retain an end of the optical fiber, said transmission member being arranged parallel to the run of the optical fiber; and a device for automatic gripping of the optical fiber by the clamping element, comprising:

means for positioning the optical fiber in a starting position where the optical fiber runs at a distance from the clamping element in a substantially perpendicular direction to said clamping element, a fiber-spacing finger, that can move between a neutral position at a distance from the optical fiber in its starting position and a position where said spacing finger keeps the optical fiber at a distance from said starting position in such a way as to bring it into an intermediate position facing the clamping element, and means for opening and closing the clamping element, configured to open the clamping element when the optical fiber has been brought by the spacing finger into said intermediate position, and to close said clamping element when the spacing finger comes back to its neutral position.

2. The machine according to claim 1, wherein the device for having the clamping element automatically grip the optical fiber further comprises a tool for cutting the optical fiber.

3. The machine according to claim 1, wherein the spacing finger is connected to a pivoting support.

4. The machine according to claim 1, wherein the spacing finger has a curved shape with its concavity oriented towards the optical fiber.

5. The machine according to claim 1, wherein the device for having the clamping element automatically grip the optical fiber comprises means for retaining an end of the optical fiber.

6. The machine according to claim 5, wherein said retaining means comprises a slit configured to wedge the optical fiber.

7. The machine according to claim 1, wherein the main area of the machine comprises an input capstan arranged in an upstream section of the main area on the run of the optical fiber and an output capstan arranged in a downstream section of the main area on the run of the optical fiber, the rotation speed of said capstans being adjustable in such a way as to generate a mechanical tension of the optical fiber between said capstans.

8. A method for positioning an optical fiber in a manufacturing machine, comprising:

providing a manufacturing machine, wherein the manufacturing machine includes:

at least one capstan and at least one pulley, said capstan(s) and pulley(s) defining a run of the optical fiber in a main area of said machine, an optical fiber guiding system comprising a transmission member and a clamping element rigidly connected to said member, able to retain an end of the optical fiber, said transmission member being arranged parallel to the run of the optical fiber, and a device for automatic gripping of the optical fiber by the clamping element, comprising:

means for positioning the optical fiber in a starting position where the optical fiber runs at a distance from the clamping element in a substantially perpendicular direction to said clamping element, a fiber-spacing finger, that can move between a neutral position at a distance from the optical fiber in its starting position and a position where said spacing finger keeps the optical fiber at a distance from said starting position in such a way as to bring it into an intermediate position facing the clamping element, and means for opening and closing the clamping element, configured to open the clamping element when the optical fiber has been brought by the spacing finger into said intermediate position, and to close said clamping element when the spacing finger comes back to its neutral position;

insertion of the optical fiber on the positioning means, the spacing finger being in its neutral position;

actuation of the spacing finger towards its spacing position, in such a way as to space the optical fiber towards its intermediate position;

actuation of the opening and closing means of the clamping element to open the clamping element;

loosening of the spacing finger towards its neutral position in such a way as to release the optical fiber into the opening of the clamping element; and actuation of the opening and closing means of the clamping element to close the clamping element in such a way as to exert a tightening force on the optical fiber.

9. The method according to claim 8, further comprising, after the closing of the clamping element, the cutting of the optical fiber between the clamping element and the positioning means whereon the fiber is inserted.

10. The method according to claim 9, further comprising, after the cutting of the optical fiber, the scrolling of the transmission member to position the optical fiber retained by the clamping element on said at least one capstan and said at least one pulley on the run of the optical fiber in the machine.

* * * * *